US008684776B2

(12) United States Patent
Yoshikawa et al.

(10) Patent No.: US 8,684,776 B2
(45) Date of Patent: Apr. 1, 2014

(54) OUTBOARD MOTOR

(75) Inventors: Yukihiro Yoshikawa, Hamamatsu (JP); Kotaro Kobayashi, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 69 days.

(21) Appl. No.: 13/542,037

(22) Filed: Jul. 5, 2012

(65) Prior Publication Data

US 2013/0012080 A1 Jan. 10, 2013

(30) Foreign Application Priority Data

Jul. 5, 2011 (JP) ..... 2011-149293

(51) Int. Cl.
*B63H 21/22* (2006.01)

(52) U.S. Cl.
USPC ..... 440/1; 440/53; 440/87

(58) Field of Classification Search
USPC ..... 440/1, 53, 63, 84, 86, 87; 701/21
See application file for complete search history.

(56) References Cited

U.S. PATENT DOCUMENTS

| | | | | |
|---|---|---|---|---|
| 6,406,342 | B1 * | 6/2002 | Walczak et al. | 440/84 |
| 7,214,113 | B2 | 5/2007 | Kojima | |
| 7,976,354 | B2 * | 7/2011 | Kubota et al. | 440/87 |
| 8,277,266 | B2 * | 10/2012 | Inoue et al. | 440/1 |

FOREIGN PATENT DOCUMENTS

| | | |
|---|---|---|
| JP | 10-250688 | 9/1998 |

* cited by examiner

*Primary Examiner* — Lars A Olson
(74) *Attorney, Agent, or Firm* — Troutman Sanders LLP

(57) ABSTRACT

A single switch unit having a pair of switches is provided in the vicinity of a throttle grip which is provided in a distal end of a tiller handle. The single switch unit is provided with a function of performing the operation for changing a tilt angle of an outboard motor body with respect to a hull and a function of performing the operation for adjusting a rotational speed of an engine of the outboard motor at the time of trolling operation. Upon simultaneous pressing of a pair of the switches, these two functions of the switch unit are switched.

7 Claims, 7 Drawing Sheets

OUTBOARD MOTOR

CROSS-REFERENCE TO RELATED APPLICATION

This application is based upon and claims the benefit of priority of the prior Japanese Patent Application No. 2011-149293, filed on Jul. 5, 2011, the entire contents of which are incorporated herein by reference.

BACKGROUND OF THE INVENTION

1. Field of the Invention

The present invention relates to an outboard motor mounted on the hull of a boat for generating power to propel the boat.

2. Description of the Related Art

Many outboard motors are equipped with a PTT (Power Trim and Tilt) device for driving an actuator to increase and decrease a vertical tilt angle of an outboard motor body with respect to a hull. A PTT switch unit for a user to operate the PTT device is provided, for example, on such places as a tiller handle, a remote controller, and an operation panel ahead of a cockpit of the boat (see Patent Document 1).

The outboard motor generally changes the rotational speed of an engine in response to rotation of a throttle grip provided, for example, at a tip end portion of the tiller handle, and thereby changes the speed of the boat. However, some outboard motors have a function of trolling operation, in which the speed of the boat is changed by limiting the speed of the boat to a predetermined low-speed range for performing trolling operation (low speed operation) and changing the rotational speed of the engine in this limited speed range not in response to the rotation of the throttle grip but in response to pressing of a pushbutton switch for trolling operation speed adjustment. The switch unit for trolling operation speed adjustment is provided, for example, on such places as a tiller handle, a remote controller, and an operation panel ahead of a cockpit of the boat (see Patent Document 2).

In the case of providing the outboard motor with the trolling operation function in addition to the function of tilting the outboard motor body with use of the PTT device, it is necessary to provide not only the PTT switch unit but also the switch unit for trolling operation speed adjustment on the places such as a tiller handle, a remote controller, and an operation panel. Accordingly, the number of switch units provided on the outboard motor or the boat increases, which increases manufacturing costs of the outboard motor or the boat.

Moreover, the tiller handle is a bar-like member extending from the body of the outboard motor body and does not have a large flat surface. Consequently, it is unfortunately not easy to place the switch unit for trolling operation speed adjustment as well as the PTT switch unit on the tiller handle while securing the operability of these units.

The PTT switch unit also has an UP switch for increasing the tilt angle of the outboard motor body and a DOWN switch for decreasing the tilt angle of the outboard motor body. The switch unit for trolling operation speed adjustment has an UP switch for increasing the rotational speed of the engine as long as the speed of the boat is kept in the aforementioned limited speed range and a DOWN switch for decreasing the rotational speed of the engine as long as the speed of the boat is kept in the aforementioned limited speed range. Thus, the PTT switch unit and the switch unit for trolling operation speed adjustment are in common with each other in the point that both the units have the UP switch and the DOWN switch.

As a result, operation of these two switch units may erroneously be conducted because the user may operate the switch unit for trolling operation speed adjustment instead of the PTT switch unit by mistake, or user may accidentally operate the PTT switch unit instead of the switch unit for trolling operation speed adjustment.

It is desirable to mount the switch unit for trolling operation speed adjustment in the vicinity of a throttle grip of a tiller handle or in the vicinity of a shift lever of a remote controller. More specifically, if the switch unit for trolling operation speed adjustment can be provided in the vicinity of the throttle grip of the tiller handle or in the vicinity of the shift lever of the remote controller, the user can press each switch button in the switch unit for trolling operation speed adjustment while gripping the throttle grip of the tiller handle or the shift lever of the remote controller. Consequently, it becomes unnecessary for the user to take his/her hand from the throttle grip, the handle, or the shift lever of the remote controller in order to press each switch button in the switch unit for trolling operation speed adjustment during driving of the boat. It becomes also unnecessary for the user to widely move his/her gaze for pressing each switch button in the switch unit. This makes it possible to provide easy operability of the boat to the user and to also enhance the safety of driving.

[Patent Document 1] Japanese Laid-open Patent Publication No. 10-250688

[Patent Document 2] Japanese Laid-open Patent Publication No. 2005-319881

SUMMARY OF THE INVENTION

In view of the above-stated problems, an object of the present invention is to provide an outboard motor capable of easily enhancing operability in both the operation for changing a tilt angle of an outboard motor body with respect to a hull and the operation for adjusting the rotational speed of a power source (engine) of the outboard motor at the time of trolling operation and also capable of providing a measure for implementing both the operations at low costs.

In order to accomplish the above object, a first outboard motor of the present invention includes: an outboard motor body having a power source, a propeller rotated by a rotational output of the power source, and a rotational output transmission mechanism which transmits the rotational output of the power source to the propeller; a fixing member for fixing the outboard motor body to a hull of a boat; an actuator mounted on the outboard motor body and on the fixing member; tilt angle control means for driving the actuator to change a vertical tilt angle of the outboard motor body with respect to the hull; rotational speed control means for controlling change in a rotational speed of the power source; rotational speed limiting means for limiting the change in the rotational speed of the power source by the rotational speed control means so that a speed of the boat is kept in a predetermined trolling operation speed range in order to perform trolling operation; a switch unit having a pair of switches for operating each of the tilt angle control means, the rotational speed control means, and the rotational speed limiting means in response to an operational input by a user; and mode switching means for switching a mode of the switch unit between a first mode and a second mode, wherein when the mode of the switch unit is switched to the first mode, the mode switching means makes one switch out of a pair of the switches function as a switch for operating the tilt angle control means to increase the tilt angle of the outboard motor body, while making the other switch function as a switch for operating the tilt angle control means to decrease the tilt angle of the outboard motor body, whereas when the mode of the switch unit is switched to the second mode, the mode switching means makes one switch out of a pair of the switches function as a switch for operating the rotational speed control means and the rotational speed limiting means to increase the rotational speed of the power source for performing the trolling operation as long as the speed of the boat is kept in the trolling operation speed range, while making the other switch function as a switch for operating the rotational speed control means and the rotational speed limiting means to decrease the rotational speed of the power source for performing the trolling operation as long as the speed of the boat is kept in the trolling operation speed range.

According to the first outboard motor of the present invention, a single switch unit having a pair of switches makes it possible to operate the tilt angle control means for changing the tilt angle of the outboard motor body, as well as to operate the rotational speed control means and the rotational speed limiting means for changing the rotational speed of the power source as long as the speed of the boat is kept in a trolling operation speed range. Thus, when two functions are incorporated in the single switch unit having a pair of switches, the number of switch units provided on the outboard motor or the boat can be reduced, and thereby increase in manufacturing costs of the outboard motor or the boat can be suppressed.

Further, as compared with the case of separately placing two switch units in two different places on the tiller handle while securing the operability of both the switch units, it is easy to place a single switch unit in one place on the tiller handle while securing the operability of the switch unit. Therefore, it becomes possible to easily enhance the operability of both the operation for changing the tilt angle of the outboard motor body and the operation for adjusting the rotational speed of the power source of the outboard motor at the time of trolling operation.

In order to accomplish the above object, a second outboard motor of the present invention according to the first outboard motor of the present invention includes a tiller handle whose proximal end is mounted on the outboard motor body and whose distal end has a grip provided thereto for navigating the boat, wherein the switch unit is provided in a vicinity of the grip of the tiller handle.

According to the second outboard motor of the present invention, a single switch unit, which performs both the operation for changing the tilt angle of the outboard motor body and the operation for adjusting the rotational speed of the power source of the outboard motor at the time of trolling operation, is provided in the vicinity of the grip of the tiller handle. Therefore, the user who drives the boat using the tiller handle can operate the switch unit to perform not only the operation for changing the tilt angle of the outboard motor body but also the operation for adjusting the rotational speed of the power source at the time of trolling operation, while gripping the grip of the tiller handle. Consequently, at the time of performing the operation for changing the tilt angle of the outboard motor body and the operation for adjusting the rotational speed of the power source in trolling operation, the user does not need to widely move his/her gaze or to take his/her hand from the grip or the handle. Therefore, it becomes possible to easily perform these operations and to enhance the safety of driving.

In order to accomplish the above object, a third outboard motor of the present invention according to the first outboard motor of the present invention includes a remote controller placed in the boat at a position distanced from the outboard motor body and having a lever for operating the rotational output transmission mechanism or the rotational speed control means by remote control, wherein the switch unit is provided on the lever of the remote controller.

According to the third outboard motor of the present invention, a single switch unit, which performs both the operation for changing the tilt angle of the outboard motor body and the operation for adjusting the rotational speed of the power source of the outboard motor at the time of trolling operation, is provided on the lever of the remote controller. Therefore, the user who drives the boat using the remote controller can operate the switch unit to perform not only the operation for changing the tilt angle of the outboard motor body but also the operation for adjusting the rotational speed of the power source at the time of trolling operation, while gripping the lever of the remote controller. Consequently, at the time of performing the operation for changing the tilt angle of the outboard motor body and the operation for adjusting the rotational speed of the power source in trolling operation, the user does not need to widely move his/her gaze or to take his/her hand from the handle or the lever of the remote controller. Therefore, it becomes possible to easily perform these operations and to enhance the safety of driving.

In order to accomplish the above object, a fourth outboard motor of the present invention is provided according to the first outboard motor of the present invention, wherein the mode switching means detects simultaneous pressing of a pair of the switches, and when the simultaneous pressing of a pair of the switches is detected, the mode switching means switches the mode of the switch unit between the first mode and the second mode.

According to the fourth outboard motor of the present invention, the user can switch the mode of the switch unit easily and reliably.

In order to accomplish the above object, a fifth outboard motor of the present invention is provided according to the first outboard motor of the present invention, wherein the mode switching means detects whether or not a throttle of the power source is in an idle state, and when the throttle of the power source is not in the idle state, the mode switching means prohibits switching of the mode from the first mode to the second mode in the switch unit.

According to the fifth outboard motor of the present invention, it becomes possible to prevent the mode of the switch unit from being switched to the second mode, i.e., the mode for adjusting the rotational speed of the power source of the outboard motor at the time of trolling operation when the boat is not in the state of performing trolling operation. Therefore, erroneous operation or false operation of the outboard motor can be prevented.

In order to accomplish the above object, a sixth outboard motor of the present invention is provided according to the first outboard motor of the present invention, wherein the mode switching means detects whether or not a shift gear in the rotational output transmission mechanism is in a neutral state, and when the shift gear in the rotational output transmission mechanism is in the neutral state, the mode switching means prohibits switching of the mode from the first mode to the second mode in the switch unit.

According to the sixth outboard motor of the present invention, it becomes possible to prevent the mode of the switch unit from being switched to the second mode, i.e., the mode for adjusting the rotational speed of the power source of the outboard motor at the time of trolling operation when the boat is not in the state of performing trolling operation. Therefore, erroneous operation or false operation of the outboard motor can be prevented.

In order to accomplish the above object, a seventh outboard motor of the present invention is provided according to the first outboard motor of the present invention, wherein the mode switching means detects whether or not the power source has any abnormalities, and when the power source has any abnormalities, the mode switching means prohibits switching of the mode from the first mode to the second mode in the switch unit.

According to the seventh outboard motor of the present invention, it becomes possible to prevent the mode of the switch unit from being switched to the second mode, i.e., the mode for adjusting the rotational speed of the power source of the outboard motor at the time of trolling operation when the power source has any abnormalities. Therefore, erroneous operation or false operation of the outboard motor can be prevented.

DETAILED DESCRIPTION OF THE PREFERRED EMBODIMENTS

Figure 1:
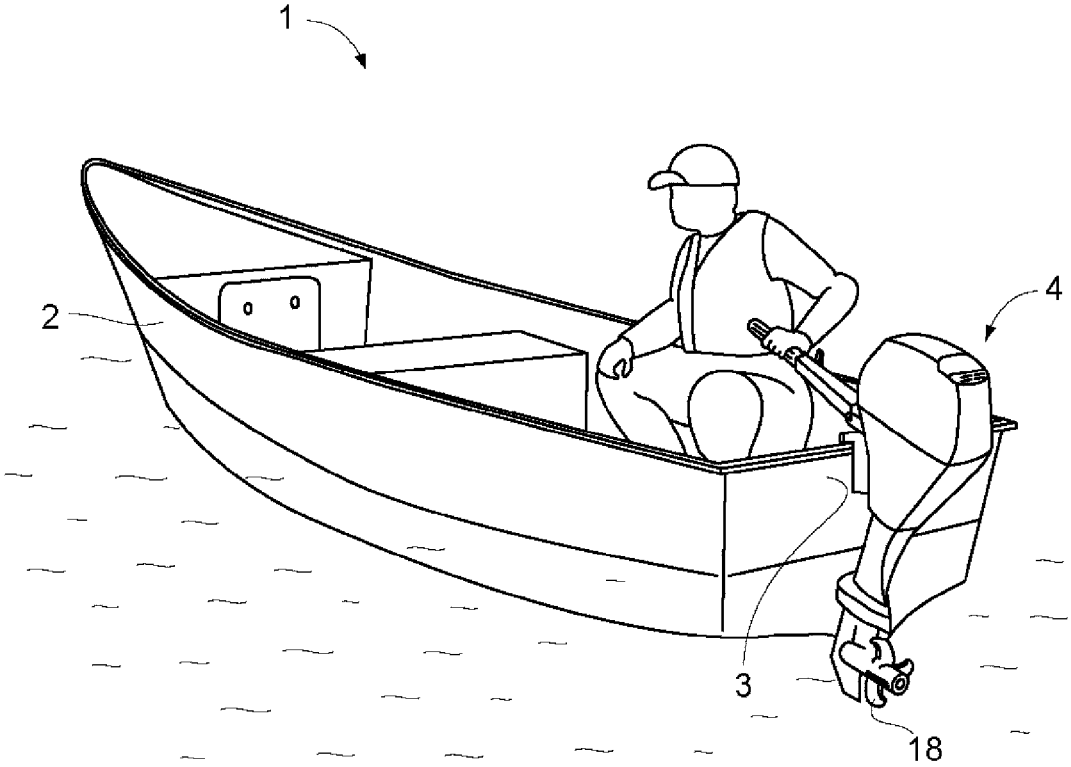
FIG. 1 is an external perspective view showing a boat on which an outboard motor according to a first embodiment of the present invention is mounted.

Embodiments of the present invention will be described hereinafter with reference to the drawings. First, a first embodiment of the present invention will be described. FIG. 1 shows a boat on which an outboard motor according to the first embodiment of the present invention is mounted. In a boat 1 in FIG. 1, an outboard motor 4 in the first embodiment of the present invention is mounted on a stern board 3 of a hull 2.

Figure 2:
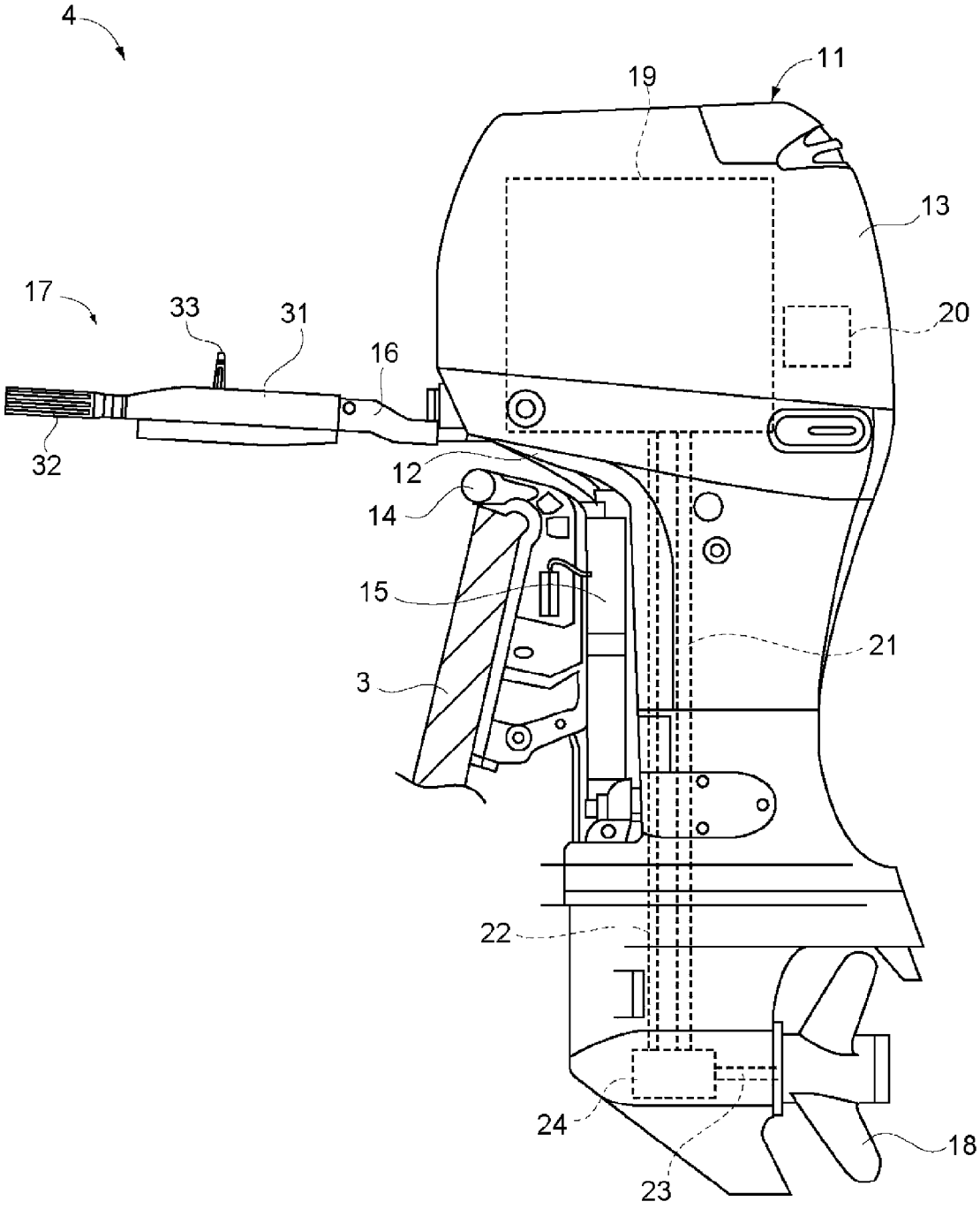
FIG. 2 is an external view showing the outboard motor according to the first embodiment of the present invention.
Figure 3:
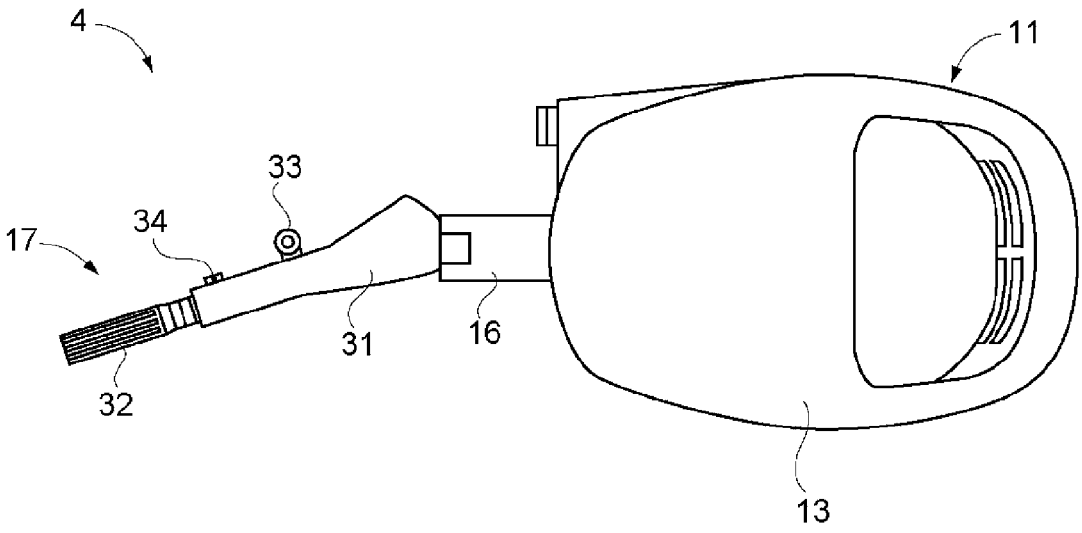
FIG. 3 is an external view showing the outboard motor in FIG. 2 as viewed from the top.

FIG. 2 and FIG. 3 show the outboard motor 4. As shown in FIG. 2 and FIG. 3, an outboard motor body 11 of the outboard motor 4 includes a casing 12 which constitutes an outer shell of the outboard motor body 11 and a cowling 13 provided in the upper part of the casing 12. The casing 12 also has a clamp bracket 14 provided as a fixing member. The outboard motor body 11 is mounted and fixed onto the hull 2 via the clamp bracket 14. A PTT actuator 15 is mounted on the clamp bracket 14 and on the outboard motor body 11 so as to be provided between the clamp bracket 14 and the outboard motor body 11. As described later, a vertical tilt angle (a tilt angle or a trim angle) of the outboard motor body 11 with respect to the hull 2 can be changed by driving the PTT actuator 15 in response to an operational input of a user. A tiller handle 17 which is one concrete example of an operation means is mounted on the outboard motor body via a steering bracket 16. Further, a propeller is provided in the lower part of the outboard motor body 11.

Provided inside the casing 12 of the outboard motor body 11 are an engine 19 as a power source, an ISC (Idle Speed Control) valve 20 for changing the rotational speed of the engine 19, a drive shaft 21 for transmitting the rotational output of the engine to the propeller 18, a shift shaft 22 for adjustably setting a rotation direction of the propeller 18, a propeller shaft 23 connected to the propeller 18, and a shift gearing system 24 for converting the rotation of the drive shaft 21 into the rotation of the propeller shaft 23 in conformity to the rotation direction set by the shift shaft 22. It is to be noted that the drive shaft 21, the shift shaft 22, the propeller shaft 23, and the shift gearing system 24 are concrete examples of the rotational output transmission mechanism.

Figure 4:
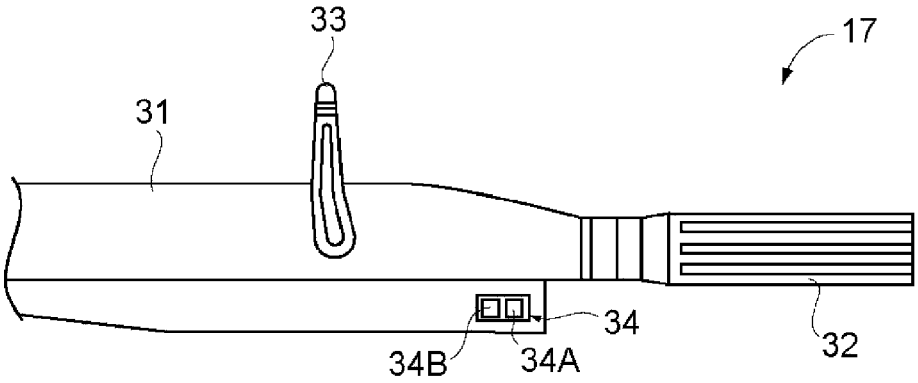
FIG. 4 is an external view showing a tiller handle of the outboard motor in FIG. 2.
Figure 5:
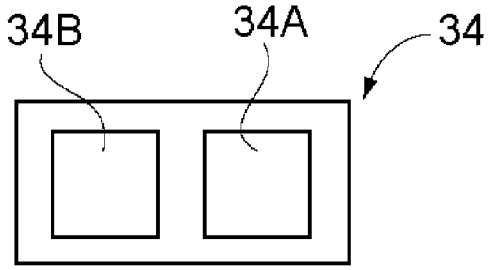
FIG. 5 is an enlarged view showing a switch unit provided on the tiller handle in FIG. 4.

FIG. 4 shows the tiller handle 17, and FIG. 5 shows a switch unit provided on the tiller handle 17. The tiller handle 17 is a handle for navigating the boat 1. The tiller handle 17 has a bar-like tiller handle body 31. A proximal end of the tiller handle body 31 is mounted on the outboard motor body 11 via the steering bracket 16 (see FIG. 2). A throttle grip 32 is provided in a distal end of the tiller handle body 31. The user can navigate the boat 1 by grasping the throttle grip 32 of the tiller handle 17 and moving the tiller handle 17 to right and left sides. The user can also change the rotational speed of the engine 19 and thereby changes the speed of the boat 1 by rotating the throttle grip 32. The tiller handle body 31 also has a shift lever 33 provided for changing the rotation direction of the propeller 18 to change the moving direction of the boat.

A switch unit 34 is provided on the tiller handle body 31 in the vicinity of the throttle grip 32. As described later, the switch unit 34 has two functions including a function of performing the operation for changing the tilt angle of the outboard motor body 11 with respect to the hull 2 and a function of performing the operation for adjusting the rotational speed of the engine 19 of the outboard motor 4 at the time of trolling operation. More specifically, the switch unit 34, which is a single switch unit, functions as both a PTT switch unit and a switch unit for engine speed adjustment at the time of trolling operation. As shown in FIG. 5, the switch unit 34 has an UP switch 34A and a DOWN switch 34B. The UP switch 34A and the DOWN switch 34B may be, for example, juxtaposed to each other in a horizontal direction. The UP switch 34A and the DOWN switch 34B may also be juxtaposed to each other in a vertical direction for example. Only a pair of the switches 34A and 34B is provided as the switches of the switch unit 34.

Figure 6:
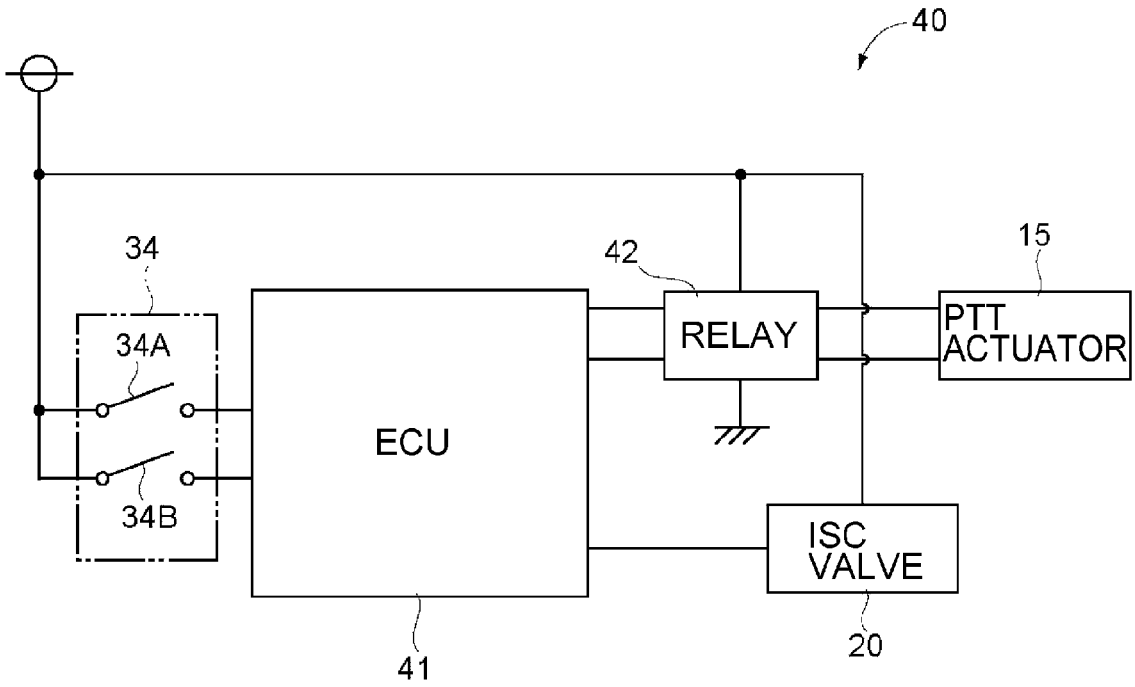
FIG. 6 is a block diagram showing a control device of the outboard motor according to the first embodiment of the present invention.

FIG. 6 shows a control device of the outboard motor 4. A control device 40 of the outboard motor 4 is a device for controlling the operation of the outboard motor 4. The device is provided, for example, inside the casing 12 of the outboard motor 4. The control device 40 includes an ECU (Engine Control Unit) 41 and a relay 42.

The ECU 41 is a unit including, for example, a microcomputer and is constituted of a CPU, a RAM, a ROM and so forth. The ECU 41 performs control to change the rotational speed of the engine 19 by, for example, changing a valve opening of the ISC valve 20 and also performs control to limit the change in the rotational speed of the engine 19 so as to keep the speed of the boat 1 in a trolling operation speed range during a later-described troll mode. Further, the ECU 41 controls various operations of the outboard motor 4, such as switching between a normal mode and a troll mode (change of functions assigned to the switch unit 34), and drive control of the PTT actuator 15. It is to be noted that the ECU 41 is a concrete example of the rotational speed control means, the rotational speed limiting means, the tilt angle control means, and the mode switching means.

The ECU 41 is connected to the UP switch 34A and the DOWN switch 34B of the switch unit 34. When the UP switch 34A is pressed, an input signal indicating the pressing is inputted into the ECU 41. When the DOWN switch 34B is pressed, an input signal indicating the pressing is inputted into the ECU 41. The ECU 41 is also connected to the PTT actuator 15 via the relay 42. As described later, the ECU 41 drives the PTT actuator 15 and thereby changes the tilt angle of the outboard motor body 11 with respect to the hull 2 in response to the pressing of the UP switch 34A and the DOWN switch 34B in the normal mode. The ECU 41 is also connected to the ISC valve 20. The ECU 41 controls the ISC valve 20 to change the rotational speed of the engine 19 within a certain range in response to the pressing of the UP switch 34A and the DOWN switch 34B in the troll mode, so that the speed of the boat 1 at the time of trolling operation is changed in a trolling speed range.

The outboard motor 4 has the normal mode (first mode) and the troll mode (second mode). The behavior of the outboard motor 4 is different in every mode. The troll mode is a mode for performing trolling operation (low speed operation) of the boat 1, whereas the normal mode is a mode for performing operation (normal operation) other than the trolling operation of the boat 1.

In the normal mode, when the user presses the UP switch 34A of the switch unit 34, the PTT actuator 15 is driven to rotate the outboard motor body 11 so that the propeller 18 moves upward. As a result, the tilt angle of the outboard motor body 11 with respect to the hull 2 can be increased. Also in the normal mode, when the user presses the DOWN switch 34B of the switch unit 34, the PTT actuator 15 is driven to rotate the outboard motor body 11 so that the propeller 18 moves downward. As a result, the tilt angle of the outboard motor body 11 with respect to the hull 2 can be decreased.

In the troll mode, when the user presses the UP switch 34A of the switch unit 34, the ISC valve 20 is driven to increase the rotational speed of the engine 19, so that the speed of the boat 1 can be increased. Also in the troll mode, when the user presses the DOWN switch 34B of the switch unit 34, the ISC valve is driven to decrease the rotational speed of the engine 19, so that the speed of the boat 1 can be decreased.

However, in the case of changing the rotational speed of the engine 19 by pressing the UP switch 34A and the DOWN switch 34B in the troll mode, the rotational speed of the engine 19 is limited within a range of the rotational speed corresponding to a predetermined trolling operation speed range (e.g., 2 knots to 10 knots) under the control of the ECU 41. More specifically, when the rotational speed of the engine 19 is less than a rotational speed corresponding to an upper limit in the trolling operation speed range, pressing of the UP switch 34A by the user increases the rotational speed of the engine 19. However, when the rotational speed of the engine 19 corresponds to the upper limit in the trolling operation speed range, pressing of the UP switch 34A by the user does not increase the rotational speed of the engine 19. Moreover, when the rotational speed of the engine 19 is more than a rotational speed corresponding to a lower limit in the trolling operation speed range, pressing of the DOWN switch 34B by the user decreases the rotational speed of the engine 19. However, when the rotational speed of the engine 19 corresponds to the lower limit in the trolling operation speed range, pressing of the DOWN switch 34B by the user does not decrease the rotational speed of the engine 19. For changing the rotational speed of the engine 19 to change the speed of the boat 1 in the normal mode, the throttle grip 32 is rotated.

Switching between the normal mode and the troll mode can be conducted by simultaneous pressing of the UP switch 34A and the DOWN switch 34B of the switch unit 34. More specifically, when the user simultaneously presses the UP switch 34A and the DOWN switch 34B in the normal mode, the mode is switched from the normal mode to the troll mode. In the troll mode, the UP switch 34A functions as a switch for increasing the rotational speed of the engine 19 within the range of a rotational speed corresponding to the trolling operation speed range, while the DOWN switch 34B functions as a switch for decreasing the rotational speed of the engine 19 within the range of the rotational speed corresponding to the trolling operation speed range. When the user simultaneously presses the UP switch 34A and the DOWN switch 34B in the troll mode, the mode is switched from the troll mode to the normal mode. In the normal mode, the UP switch 34A functions as a switch for increasing the tilt angle of the outboard motor body 11, while the DOWN switch 34B functions as a switch for decreasing the tilt angle of the outboard motor body 11.

However, switching from the normal mode to the troll mode is not constantly performed corresponding to the simultaneous pressing of the UP switch 34A and the DOWN switch 34B. The switching is performed upon simultaneous pressing of the UP switch 34A and the DOWN switch 34B only when all the conditions shown below are fulfilled:

(a) the shift gearing system 24 is not in a neutral state;

(b) the throttle of the engine 19 is in an idle state; and (c) the engine 19 has no abnormalities.

In the troll mode, the mode can be switched from the troll mode to the normal mode when the throttle grip is rotated and the rotational speed of the engine is increased to a predetermined rotational speed or higher.

Figure 7:
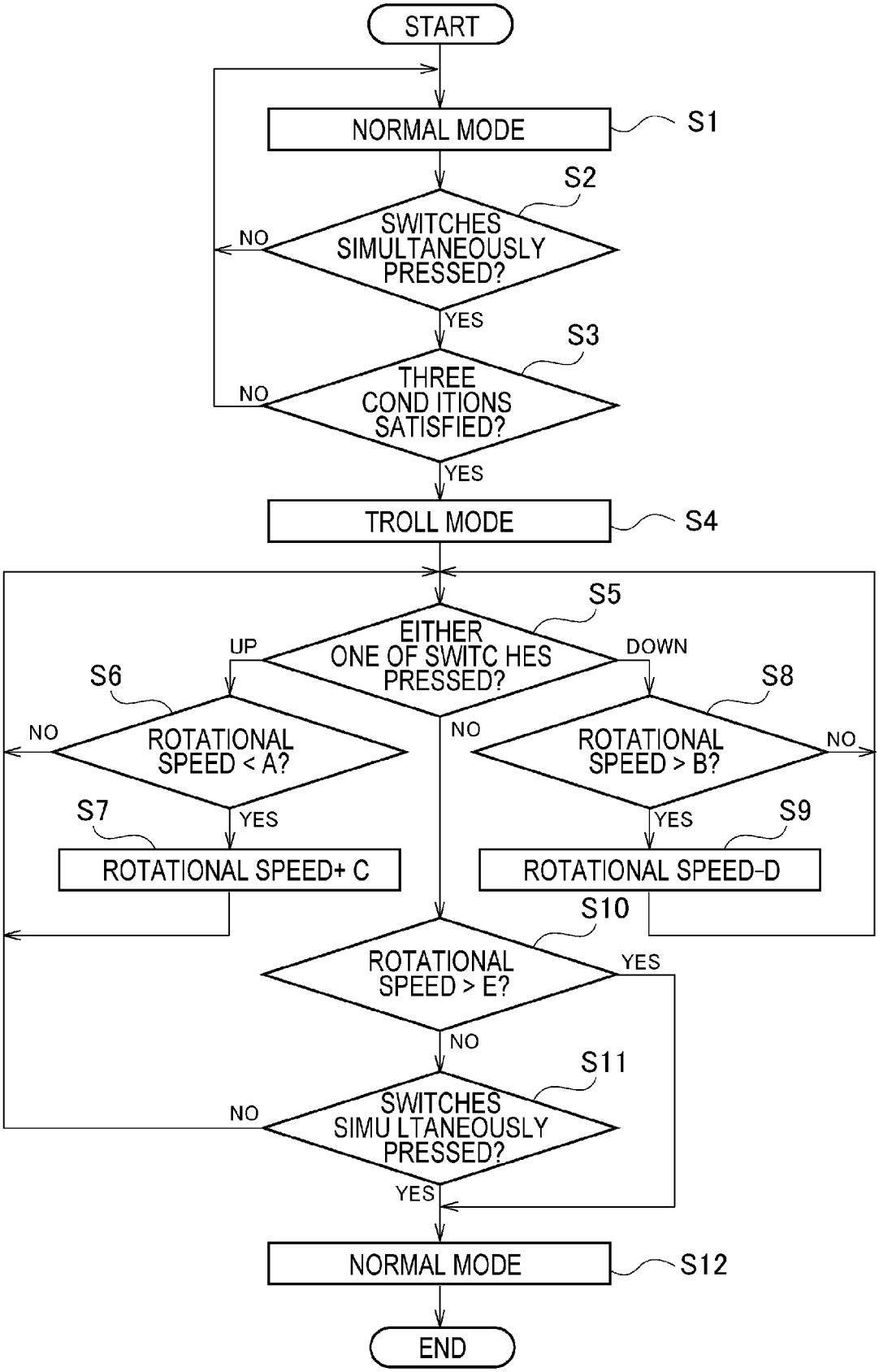
FIG. 7 is a flowchart for showing the operation of an ECU at the time of switching between a normal mode and a troll mode and at the time of performing control of the rotational speed of an engine in the troll mode in the outboard motor according to the first embodiment of the present invention.

FIG. 7 is a flowchart for showing the operation of the ECU 41 at the time of performing switching between the normal mode and the troll mode and at the time of performing control of the rotational speed of the engine 19 in the troll mode. The flowchart shown in FIG. 7 is implemented when the CPU of the ECU 41 executes a program stored in a ROM. As shown in FIG. 7, during the normal mode (Step S1), the ECU 41 monitors whether or not the UP switch 34A and the DOWN switch 34B of the switch unit 34 are simultaneously pressed (Step S2). During the normal mode, the UP switch 34A functions as a switch for increasing the tilt angle of the outboard motor body 11, while the DOWN switch 34B functions as a switch for decreasing the tilt angle of the outboard motor body 11.

When the user simultaneously presses the UP switch 34A and the DOWN switch 34B, the ECU 41 detects the simultaneous pressing (Step S2: YES). More specifically, the ECU 41 determines that the UP switch 34A and the DOWN switch 34B were simultaneously pressed in the case where a period of time between the moment when the pressing of either one of the UP switch 34A and the DOWN switch 34B was detected and the moment when the pressing of the other switch was detected is equal to or less than a predetermined time T1 (e.g., 0.5 second), and pressing of both the switches has been kept for a predetermined time T2 (e.g., 1 second) since the detection of the pressing of both the switches.

After the simultaneous pressing of the UP switch 34A and the DOWN switch 34B was detected, the ECU 41 determines whether or not all the aforementioned conditions (a), (b), and (c) are satisfied (Step S3). More specifically, the ECU 41 determines whether or not the shift gearing system 24 is in a neutral state. If the shift gearing system 24 is in the neutral state, the ECU 41 prohibits switching from the normal mode to the troll mode even when simultaneous pressing of the UP switch 34A and the DOWN switch 34B is detected. The ECU 41 also detects whether or not the throttle of the engine 19 is in an idle state. If the throttle of the engine 19 is not in the idle state, the ECU 41 prohibits switching from the normal mode to the troll mode even when simultaneous pressing of the UP switch 34A and the DOWN switch 34B is detected. The ECU 41 also detects whether or not the engine 19 has any abnormalities. If the engine has any abnormalities, the ECU 41 prohibits switching from the normal mode to the troll mode even when simultaneous pressing of the UP switch 34A and the DOWN switch 34B is detected.

When all the conditions (a), (b), and (c) are satisfied (Step S3: YES), i.e., when the shift gearing system 24 is not in the neutral state, the throttle of the engine 19 is in the idle state, and the engine 19 has no abnormalities, then the ECU 41 switches the mode from the normal mode to the troll mode (Step S4). As a consequence, the UP switch 34A functions as a switch for increasing the rotational speed of the engine 19 within the range of a rotational speed corresponding to the trolling operation speed range, while the DOWN switch 34B functions as a switch for decreasing the rotational speed of the engine 19 within the range of the rotational speed corresponding to the trolling operation speed range. When the mode is switched from the normal mode to the troll mode, the information indicating that the mode has switched may be displayed on a display (not shown) or the like provided on the operation panel, or a buzzer sound may be emitted.

When the user presses the UP switch 34A during the troll mode (Step S5: UP), the ECU 41 detects the pressing, and controls the ISC valve 20 to increase the rotational speed of the engine 19 by C only when the rotational speed of the engine 19 at that point is less than A (Steps S6, S7). In this case, A represents a rotational speed of the engine 19 (e.g., 1500 rpm) corresponding to an upper limit in the trolling operation speed range, while C represents a predetermined unit rotational-speed increase of the rotational speed of the engine 19 (e.g., 50 rpm). When the pressing of the UP switch 34A is detected and the rotational speed of the engine 19 at that point is A, then the ECU 41 controls to maintain the rotational speed of the engine 19 as it is.

On one hand, when the user presses the DOWN switch 34B during the troll mode (Step S5: DOWN), the ECU 41 detects the pressing, and controls the ISC valve 20 to decrease the rotational speed of the engine 19 by D only when the rotational speed of the engine 19 at that point is more than B (Steps S8, S9). In this case, B represents a rotational speed of the engine 19 (e.g., 500 rpm) corresponding to a lower limit in the trolling operation speed range, while D represents a predetermined unit rotational-speed decrease of the rotational speed of the engine 19 (e.g., 50 rpm). When the pressing of the DOWN switch 34B is detected and the rotational speed of the engine 19 at that point is B, then the ECU 41 controls to maintain the rotational speed of the engine 19 as it is.

On the other hand, when the user rotates the throttle grip 32 and increases the rotational speed of the engine 19 to a value larger than E during the troll mode, the ECU 41 detects the increase (Step S10: YES), and switches the mode from the troll mode to the normal mode (Step S12). In this case, E represents, for example, a rotational speed (e.g., 1500 rpm) of the engine 19 corresponding to an upper limit in the trolling operation speed range, or a rotational speed of the engine 19 corresponding to a speed slightly larger than the upper limit in the trolling operation speed range.

When the user simultaneously presses the UP switch 34A and the DOWN switch 34B during the troll mode, the ECU 41 detects the simultaneous pressing (Step S11: YES). The ECU 41 then switches the mode from the troll mode to the normal mode (Step S12). As a consequence, the UP switch 34A functions as a switch for increasing the tilt angle of the outboard motor body 11, while the DOWN switch 34B functions as a switch for decreasing the tilt angle of the outboard motor body 11. When the mode is switched from the troll mode to the normal mode, the information indicating that the mode has switched may be displayed on a display (not shown) or the like provided on the operation panel, or a buzzer sound may be emitted.

In the outboard motor 4 according to the embodiment of the present invention as shown in the foregoing description, it becomes possible to change the tilt angle of the outboard motor body 11 with the single switch unit 34 having a pair of the switches 34A and 34B as well as to change the rotational speed of the engine 19 so as to change the speed of the boat in the trolling operation speed range. Thus, when two functions are incorporated in the single switch unit 34 having a pair of the switches 34A and 34B, the number of switch units provided on the tiller handle 17 of the outboard motor 4 can be reduced, and thereby increase in manufacturing costs of the outboard motor 4 can be suppressed.

Moreover, providing the single switch unit 34 in one place of the tiller handle 17 makes it possible to easily secure sufficient operability of the switch unit 34 and to easily enhance the operability of both the operation for changing the tilt angle of the outboard motor body 11 and the operation for adjusting the rotational speed of the engine 19 at the time of trolling operation.

In the outboard motor 4, the switch unit 34 is provided in the vicinity of the throttle grip 32 of the tiller handle 17. Therefore, the user who drives the boat 1 using the tiller handle 17 can operate the switch unit 34 to perform the operation for changing the tilt angle of the outboard motor body 11 or the operation for adjusting the rotational speed of the engine 19 at the time of trolling operation while gripping the throttle grip 32 of the tiller handle 17. Consequently, at the time of performing the operation for changing the tilt angle of the outboard motor body 11 and the operation for adjusting the rotational speed of the engine 19 in trolling operation, the user does not need to widely move his/her gaze or to take his/her hand from the throttle grip 32 or the tiller handle 17. Therefore, the user can easily perform the operation for changing the tilt angle of the outboard motor body 11 or the operation for adjusting the rotational speed of the engine 19 at the time of trolling operation, and can enhance the safety of driving.

In the outboard motor 4, the user can switch the mode by simultaneously pressing the UP switch 34A and the DOWN switch 34B. Accordingly, the user can switch the mode of the switch unit 34 easily and reliably.

In the outboard motor 4, the mode is not switched to the troll mode when any one of three conditions, including (a) the shift gearing system 24 is not in a neutral state, (b) the engine 19 is in an idle state, and (c) the engine 19 has no abnormalities, is not satisfied as mentioned above. Therefore, erroneous operation or false operation of the outboard motor 4 can be prevented.

Figure 8:
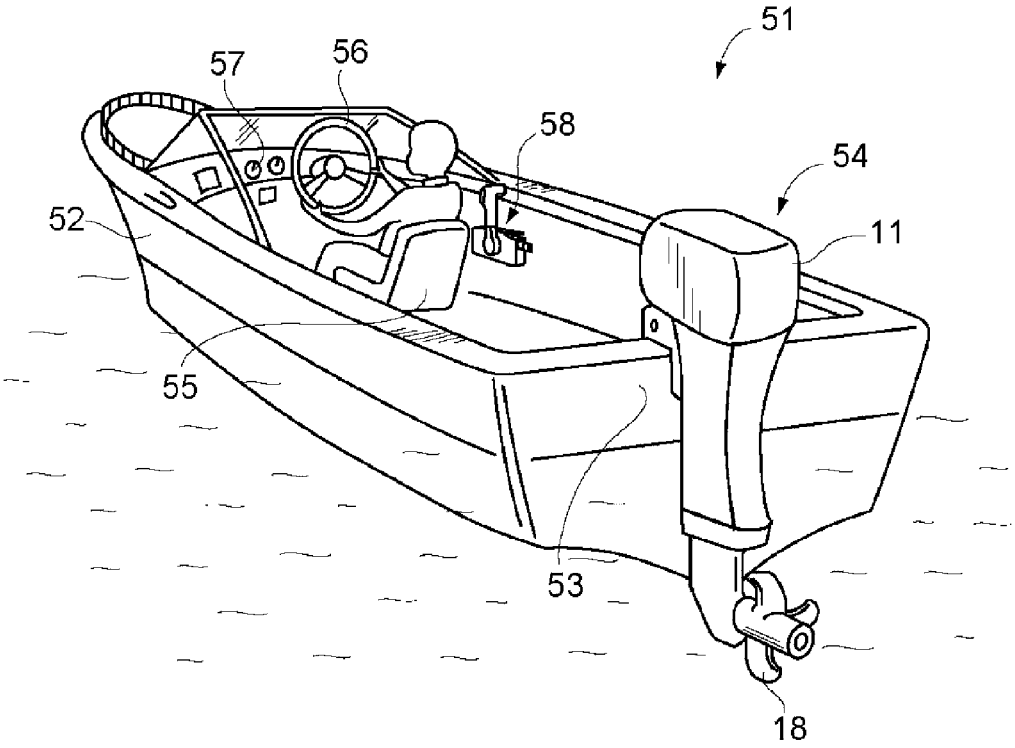
FIG. 8 is an external perspective view showing a boat on which an outboard motor according to a second embodiment of the present invention is mounted.
Figure 10:
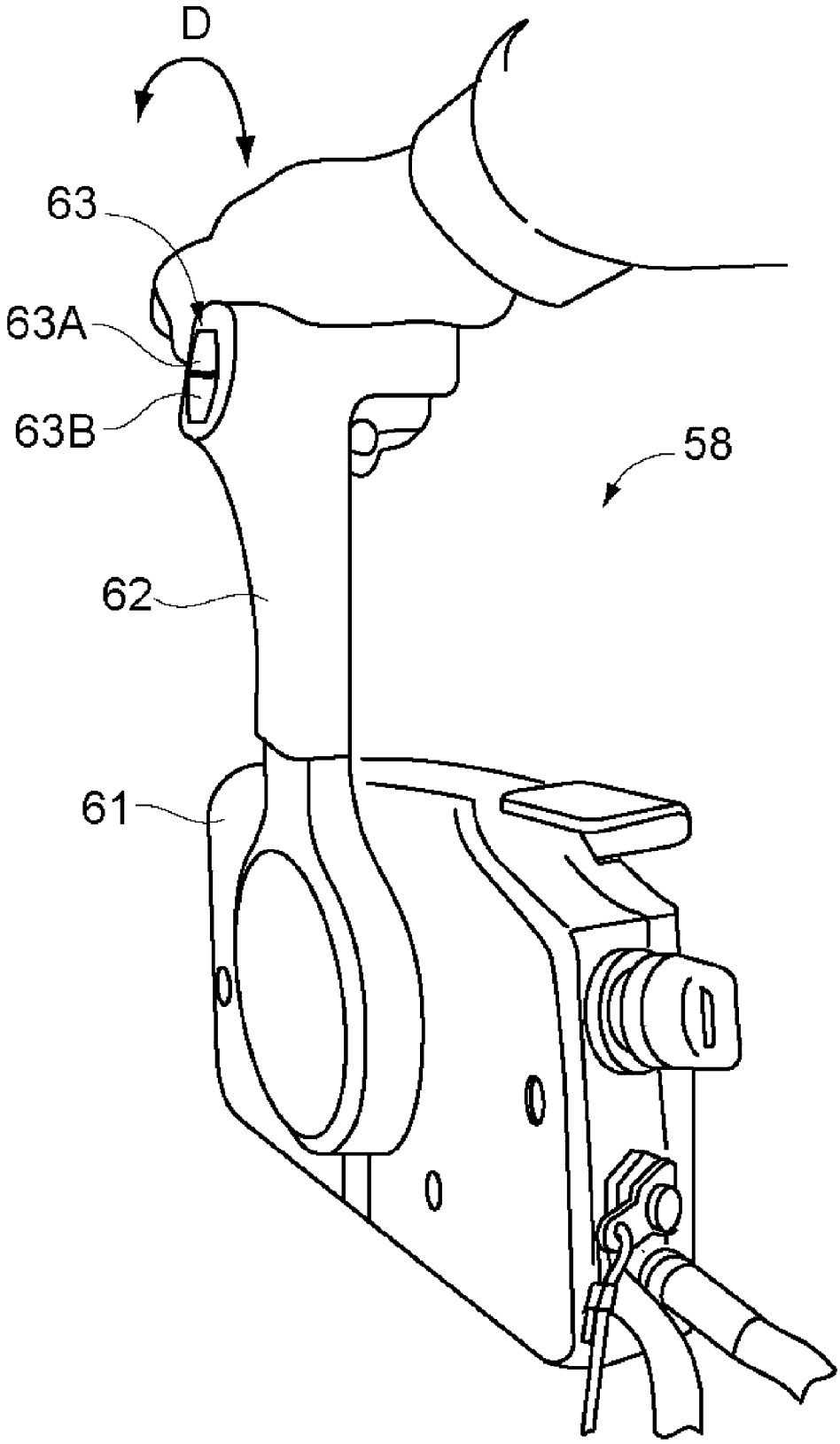
FIG. 10 is an explanatory view showing the remote controller in FIG. 9 under operation.

Next, a second embodiment of the present invention will be described. FIG. 8 shows a boat on which an outboard motor according to the second embodiment of the present invention is mounted. Fig. and FIG. 10 show a remote controller in the outboard motor according to the second embodiment. In the description of the second embodiment, component members identical to those in the above-described first embodiment are designated by identical reference signs to omit description.

The second embodiment is characterized in that a single switch unit 63 for use in both the operation for changing the tilt angle of an outboard motor body and the operation for adjusting the rotational speed of an engine 19 at the time of trolling operation is provided on a remote control lever 62 of a remote controller 58.

More specifically, in a boat 51 in FIG. 8, a cockpit 55 is provided in a hull 52, and a handle 56 and an operation panel 57 are provided ahead of the cockpit 55. An outboard motor 54 according to the second embodiment of the present invention is mounted on a stern board 53 of the hull 52. The remote controller 58 for operating the outboard motor 54 by remote control is further provided in the hull 52.

Figure 9:
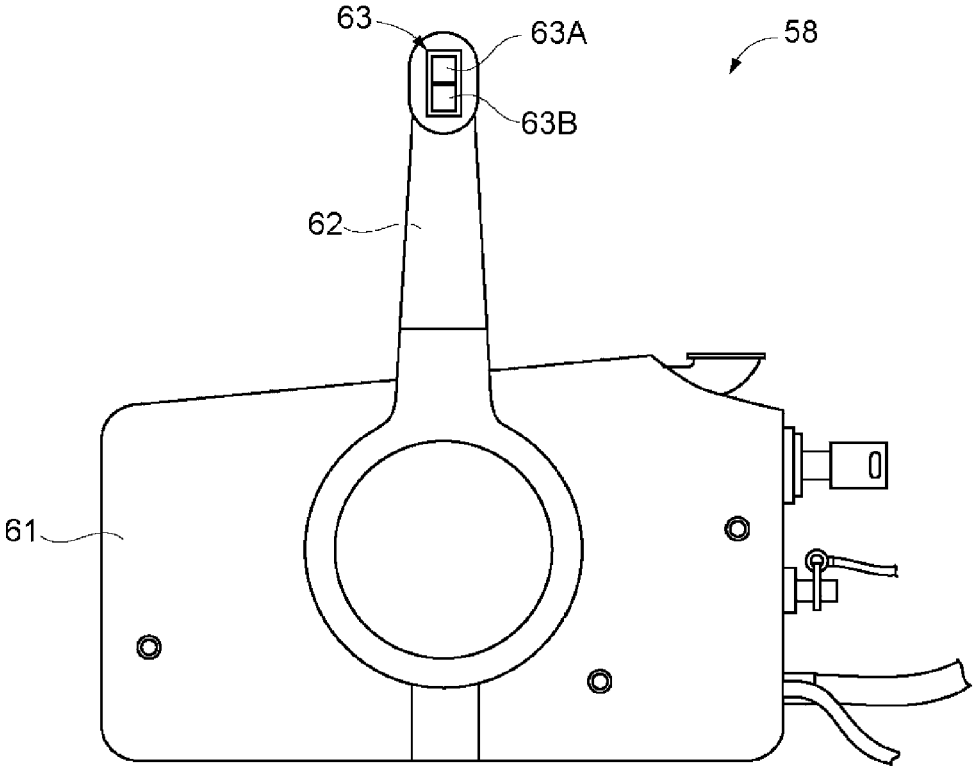
FIG. 9 is an enlarged view showing a remote controller of the outboard motor provided on the boat in FIG. 8.

As shown in FIG. 9, the remote controller 58 includes a controller body 61 and a remote control lever 62 provided on the controller body 61. The user can control the rotational speed of the engine 19 and the rotation direction of the propeller 18 by grasping the remote control lever 62 with the right hand as shown in FIG. 10 and tilting the remote control lever 62 as shown in arrow D in FIG. 10 while being seated in the cockpit 55.

A single switch unit 63 having an UP switch 63A and a DOWN switch 63B is provided at a tip end portion of the remote control lever 62. Like the switch unit 34, the switch unit 63 functions as a switch unit for changing the tilt angle of the outboard motor body 11 in the normal mode, while functioning as a switch for changing the rotational speed of the engine 19 within the range of a rotational speed corresponding to a trolling operation speed range in the troll mode. The user can easily press each of the UP switch 63A and the DOWN switch 63B with the right thumb while gripping the remote control lever 62 with the right hand as shown in FIG. 10.

With the thus-structured outboard motor 54 according to the second embodiment of the present invention, the same operation effects as those of the outboard motor 4 in the above-described first embodiment of the present invention can be obtained.

It is to be noted that the single switch unit 34 (63) having both the function of changing the tilt angle of the outboard motor body 11 and the function of changing the rotational speed of the engine 19 within the range of a rotational speed corresponding to the trolling operation speed range may be provided on the operation panel 57 of the boat 1.

In the embodiment described above, the outboard motor is structured so that the mode is not switched from the normal mode to the troll mode upon simultaneous pressing of the UP switch 34A (63A) and the DOWN switch 34B (63B) when any one of three conditions, including (a) the shift gearing system 24 is not in a neutral state, (b) the throttle of the engine 19 is in an idle state, and (c) the engine 19 has no abnormalities, is not satisfied. However, the present invention is not limited to this structure. For example, the outboard motor may be structured so that switching from the normal mode to the troll mode is permitted upon simultaneous pressing of the UP switch 34A (63A) and the DOWN switch 34B (63B) when the conditions (a) and (b) are satisfied. Conditions other than the conditions (a), (b) and (c) may be added as the prerequisites for permitting switching to the troll mode.

It should be understood that the present invention can appropriately be modified without departing from the spirit and principles of the invention as set forth and defined by the appended claims and throughout the specification. Therefore, the outboard motors having such modifications are intended to be embraced in the technical scope of the present invention.

According to the present invention, it becomes possible to easily enhance operability in both the operation for changing the tilt angle of the outboard motor body with respect to the hull and the operation for adjusting the rotational speed of the power source of the outboard motor at the time of trolling operation and to implement both the operations at low costs.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An outboard motor, comprising:

an outboard motor body that has a power source, a propeller rotated by a rotational output of the power source, and a rotational output transmission mechanism which transmits the rotational output of the power source to the propeller;

a fixing member that fixes the outboard motor body to a hull of a boat;

an actuator mounted on the outboard motor body and on the fixing member;

tilt angle control means that drives the actuator to change a vertical tilt angle of the outboard motor body with respect to the hull;

rotational speed control means that controls change in a rotational speed of the power source;

rotational speed limiting means that limits the change in the rotational speed of the power source by the rotational speed control means so that a speed of the boat is kept in a predetermined trolling operation speed range in order to perform trolling operation;

a switch unit that has a pair of switches for operating each of the tilt angle control means, the rotational speed control means, and the rotational speed limiting means in response to an operational input by a user; and mode switching means that switches a mode of the switch unit between a first mode and a second mode, wherein when the mode of the switch unit is switched to the first mode, the mode switching means makes one switch out of the pair of the switches function as a switch for operating the tilt angle control means to increase the tilt angle of the outboard motor body, while making the other switch function as a switch for operating the tilt angle control means to decrease the tilt angle of the outboard motor body, whereas when the mode of the switch unit is switched to the second mode, the mode switching means makes one switch out of the pair of the switches function as a switch for operating the rotational speed control means and the rotational speed limiting means to increase the rotational speed of the power source for performing the trolling operation as long as the speed of the boat is kept in the trolling operation speed range, while making the other switch function as a switch for operating the rotational speed control means and the rotational speed limiting means to decrease the rotational speed of the power source for performing the trolling operation as long as the speed of the boat is kept in the trolling operation speed range.

2. The outboard motor according to claim 1, comprising a tiller handle whose proximal end is mounted on the outboard motor body and whose distal end has a grip provided thereto for navigating the boat, wherein the switch unit is provided in a vicinity of the grip of the tiller handle.

3. The outboard motor according to claim 1, comprising a remote controller placed in the boat at a position distanced from the outboard motor body and having a lever for operating the rotational output transmission mechanism or the rotational speed control means by remote control, wherein the switch unit is provided on the lever of the remote controller.

4. The outboard motor according to claim 1, wherein the mode switching means detects simultaneous pressing of the pair of the switches, and when the simultaneous pressing of the pair of the switches is detected, the mode switching means switches the mode of the switch unit between the first mode and the second mode.

5. The outboard motor according to claim 1, wherein the mode switching means detects whether or not a throttle of the power source is in an idle state, and when the throttle of the power source is not in the idle state, the mode switching means prohibits switching of the mode from the first mode to the second mode in the switch unit.

6. The outboard motor according to claim 1, wherein the mode switching means detects whether or not a shift gear in the rotational output transmission mechanism is in a neutral state, and when the shift gear in the rotational output transmission mechanism is in the neutral state, the mode switching means prohibits switching of the mode from the first mode to the second mode in the switch unit.

7. The outboard motor according to claim 1, wherein the mode switching means detects whether or not the power source has any abnormalities, and when the power source has any abnormalities, the mode switching means prohibits switching of the mode from the first mode to the second mode in the switch unit.

* * * * *